US005186030A

United States Patent [19]

Lin

[11] Patent Number: 5,186,030

[45] Date of Patent: * Feb. 16, 1993

[54] LOCKING DEVICE FOR AN AUXILIARY LOCK

[75] Inventor: Jui C. Lin, Kaohsiung Hsien, Taiwan

[73] Assignee: Taiwan Fu Hsing Industry Co., Ltd., Kaohsiung Hsien, Taiwan

[ * ] Notice: The portion of the term of this patent subsequent to Apr. 30, 2008 has been disclaimed.

[21] Appl. No.: 796,781

[22] Filed: Nov. 25, 1991

[51] Int. Cl.[5] ..... E05B 9/04

[52] U.S. Cl. ..... 70/190; 70/379 R; 70/381; 70/449; 70/224

[58] Field of Search ..... 70/379 R, 379 A, 381, 70/448–449, 452, 224, 123, 139, 190

[56] References Cited

U.S. PATENT DOCUMENTS 2,078,168 4/1937 Stone et al. ..... 70/285
3,011,331 12/1961 Williams ..... 70/24
3,269,158 8/1966 André70 ..... 379 R/
3,593,548 7/1971 Kendrick ..... 70/129
5,010,749 4/1991 Lin ..... 70/190

FOREIGN PATENT DOCUMENTS 355840 7/1922 Fed. Rep. of Germany ..... 70/284
2612232 9/1988 France ..... 70/379 R

*Primary Examiner*—Renee S. Luebke
*Assistant Examiner*—D. Boucher
*Attorney, Agent, or Firm*—Jacobson, Price, Holman & Stern

[57] ABSTRACT

A locking device for an auxiliary lock comprising a rotatable ring, able to be rotated at the outside of a lock to turn an actuating wheel 90°, said actuating wheel having an 8-shaped opening for an actuating plate of the dead bolt to pass through so that the actuating plate can be turned 90° to extend the dead bolt latch out to lock a door.

4 Claims, 2 Drawing Sheets

LOCKING DEVICE FOR AN AUXILIARY LOCK

BACKGROUND OF THE INVENTION

There is a locking device for an auxiliary lock of U.S. Pat. No. 5,010,749, which comprises a rotatable ring and a base. The ring is fitted around the auxiliary lock and combined with the base. Then they are mounted in the door to let a large part of the rotatable ring be exposed outside the door, and rotating the ring can cause the dead bolt of the auxiliary lock to extend out locking the door.

SUMMARY OF THE INVENTION

This invention has been devised to supply a different structure for locking an auxiliary lock from the locking device mentioned above, wherein the auxiliary lock can be locked without using a correct key from the outside of the door, but has to use a correct key from the outside to open the door.

The locking device for an auxiliary lock in the present invention comprises a rotatable ring for the auxiliary lock to combined with, and a base for containing the rotatable ring combined with the lock. The base has a hole for an actuating wheel to combine with, and the actuating wheel has an 8-shaped hole in its vertical side for an actuating plate of the dead bolt to pass through so that the actuating plate can be turned 90° by the actuating wheel rotated by the rotatable ring to lock the lock.

DETAILED DESCRIPTION OF THE INVENTION

Figure 1:
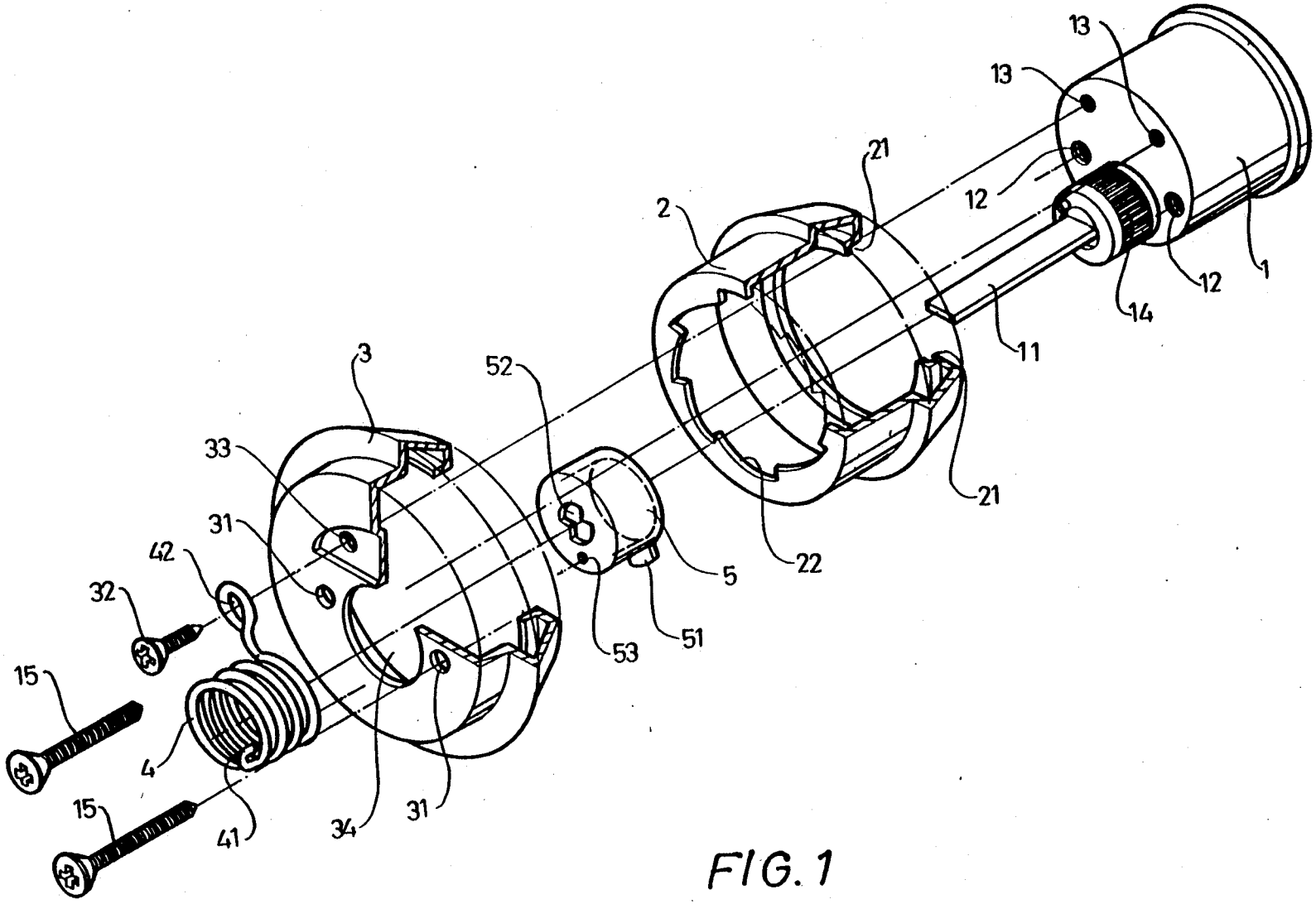
FIG. 1 is an exploded perspective view of the locking device for an auxiliary lock in the present invention.

The locking device for an auxiliary lock, as shown in FIG. 1, comprises a rotatable ring 2, a base 3, a coiled spring 4 and an actuating wheel 5 and a traditional auxiliary lock 1. The actuating plate 11 of the lock 1 goes through the dead bolt (not drawn out in the Figures), and the lock is additionally provided with two female-threaded holes 12 for screws 15 to pass from the inside of a door through holes 31 in the base 3 so that said screws can fix this locking device with the lock 1 together on a door.

The lock 1 is also additionally provided with a screw holes 13 for screws 32 to pass through to screw in holes 33 in the base 3 to assemble the base 3 with the lock 1 so that the lock 1 cannot be illegally broken and taken off after mounted in a door.

The rotatable ring 2 is to be combined with the lock 1 before combining the base 3 with the lock 1, and is able to rotate in the base 3 and on the outside of the lock 1. Ring 2 has and a peripheral recessed lip 21 at the outer end for the outer flange of the lock 1 to fit in after the ring 2 is fitted around the lock 1 and ratchet teeth 22 spaced apart around the inner peripheral edge. The ratchet teeth 22 enable the ring 2 to rotate only in one direction clock-wise or counterclockwise according to practical need for the opening direction of a door.

Figure 2:
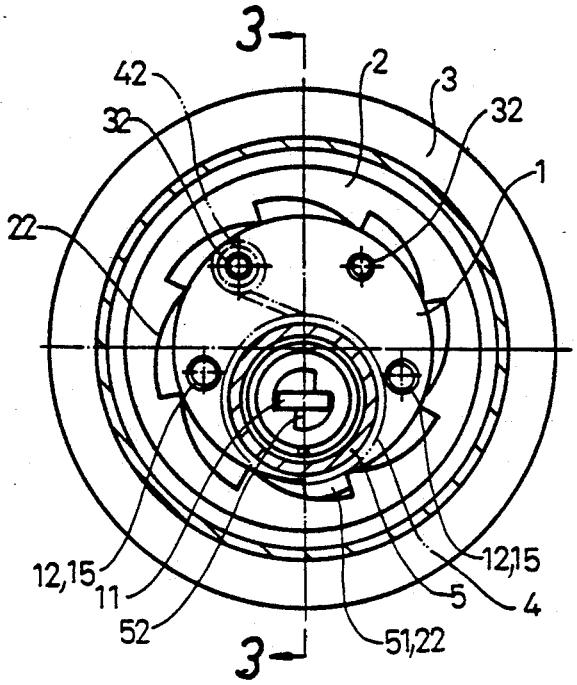
FIG. 2 is a cross-sectional view of 2—2 line in FIG. 3.
Figure 3:
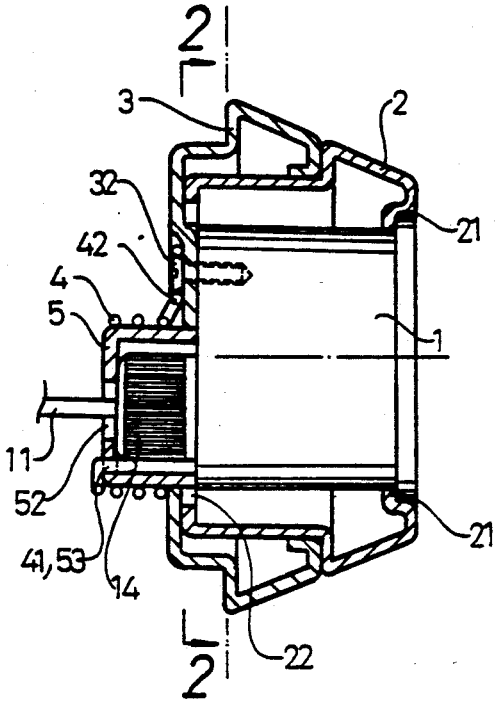
FIG. 3 is a cross-sectional view of 3—3 line in FIG. 2.

The actuating wheel 5 is to be combined with lock 1 after the lock 1 is combined with the rotatable ring 2, by positioning the wheel 5 around a cap 14 of the actuating plate 11 as shown in FIGS. 2, 3, and the coiled spring 4 is placed around the actuating wheel 5, having one of its ends 41 upright to insert in a hole in the actuating wheel 5 and the other end 42 looped for the screw 32 to pass through and to be held steadily. Therefore, the actuating wheel 5 can be automatically rotated back to its original position by the elasticity of the spring 4 after rotated by the actuating plate 11.

The base 3 has two holes 33 for screws 32 to pass through to screw with screw holes 13 in the lock 1 to assemble the lock 1 with the base 3, and two holes 31 for screws 15 to pass through from the inside of a door to screw with the two female-threaded holes 12 so that the lock 1 and the base 3 cannot be illegally broken in spite of their exposing to the outside of a door. The base 3 also has a round opening 34 for the actuating wheel 5 to fit in so that the base 3 can rotate with the wheel 5 as a center.

The actuating wheel 5 is adapted to fit and able to rotate in the opening 34, having a tooth 51 projecting sidewise from the outer surface to engage with and be stopped by one of the ratchet teeth 22 in the rotatable ring 2 and a hole 53 in the end face for the upright end 41 of the spring 4 to insert therein to enable the spring 4 to recover its original position automatically so that the tooth 51 may always engage with one of the ratchet teeth 22 in the rotatable ring 2. The actuating wheel 5 also has an 8-shaped opening 52 in its vertical side for the actuating plate 11 to pass through so that the actuating wheel 5 can stop or rotate the actuating plate 11 together, while said wheel 5 recovers its original position or rotates.

As FIGS. 2, 3 show, the lock 1 and the dead bolt are in unlocked condition with the dead bolt latch retracted, and the actuating plate 11 is in horizontal position, the tooth 51 of the actuating wheel 5 being in contact with and stopped by one of the ratchet teeth. If the lock is needed to be locked under this unlocked condition, there are two ways listed as below.

(1) The turning button at the inside of the door can be turned to make the actuating plate 11 rotate clockwise 90°, but turning idle in the 8-shaped opening 52 and not moving the actuating wheel 5.

Figure 4:
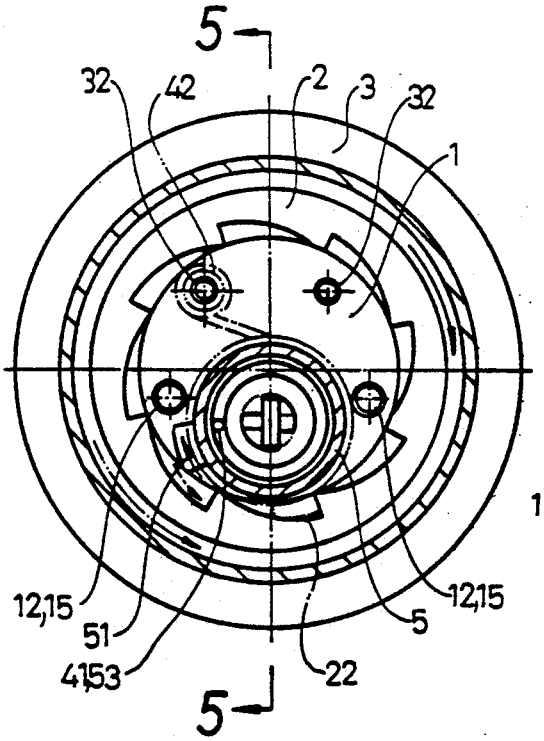
FIG. 4 is a cross-sectional view of 4—4 line in FIG. 5.
Figure 5:
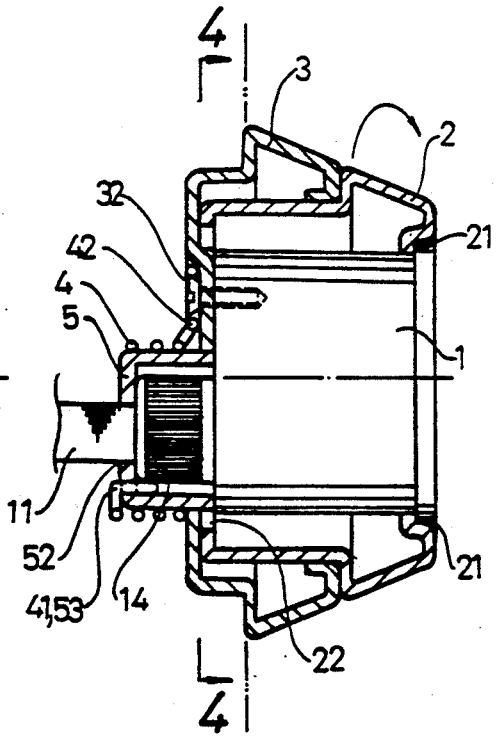
FIG. 5 is a cross-sectional view of 5—5 line in FIG. 4.

(2) The lock 1 can be locked without a correct key from the outside of the door, by turning the rotable ring 2 clockwise 90°. As one of the ratchet teeth 22 can move the tooth 51 of the actuating wheel 5, which is then rotated 90° as shown in FIG. 4; then the tooth 51 separates from one of the ratchet teeth 22; the actuating plate 11 is also rotated 90° by the actuating wheel 5 so that the dead bolt latch can be allowed to extend out to lock the door. When turning force to the rotatable ring 2 disappears, the actuating wheel 5 can be rotated counterclockwise back to its original position by the spring 4, with the tooth 51 coming to engage with one of the ratchet teeth 22, but impossible to rotate ..the actuating plate 11 now stopped by the dead bolt; so the actuating wheel 5 only rotates idle 90° counterclockwise back to the position marked with dotted line shown in FIG. 4.

If the rotatable ring 2 shown in FIG. 2 should be rotated 90° counterclockwise, the actuating wheel 5 can also rotate counterclockwise 90°, with the tooth 51 separating from one of the ratchet teeth 22 but not rotating the actuating plate 11, in other words, the actuating wheel 5 only rotates idle because of the empty space of the 8-shaped opening 52, unable to lock this lock.

If the lock is to be unlocked after locked, either a correct key has to be used at the outside of the door or the turning button at the inside of the door has to be turned, for turning the actuating plate 11 from the vertical position shown in FIG. 4 to the horizontal position shown in FIG. 2.

What is claimed is:

1. A locking device for an auxiliary lock comprising a rotatable ring, a base, an actuating wheel and a coiled spring, said rotatable ring having a peripheral lip to combine with a flange of an auxiliary lock to be fitted around the lock and combined with the base at one vertical side; said lock, said actuating wheel and said base being fixed firmly on a door by means of screws inserting from one side of the door through the base, the actuating wheel and the lock; said rotatable ring being able to rotate the actuating wheel 90°, said actuating wheel being provided with an 8-shaped opening in its vertical side for an actuating plate of a dead bolt to pass through, said actuating plate being able to be rotated 90° by the actuating wheel for causing a latch of the dead bolt to be extended to lock the door when the said actuating wheel is rotated 90° by said rotatable ring.

2. The locking device for an auxiliary lock as claimed in claim 1, wherein said rotatable ring and said actuating wheel each have a different axis for rotation, and the inner peripheral edge of the rotatable ring always contacts with the outer surface of the actuating wheel so that rotation of said rotatable ring can cause rotation of said actuating wheel.

3. The locking device for an auxiliary lock as claimed in claim 1, wherein said rotatable ring has an inner peripheral edge provided with one-way ratchet teeth and said actuating wheel is provided with a projecting-sidewise tooth to engage with and be rotated by one of said ratchet teeth in the rotatable ring.

4. The locking device for an auxiliary lock as claimed in claim 1, wherein said actuating wheel can be automatically rotated back to its original position by a coiled spring provided to fit around said actuating wheel after it is rotated.

* * * * *